US007018263B2

(12) United States Patent
Tiefel et al.

(10) Patent No.: US 7,018,263 B2
(45) Date of Patent: Mar. 28, 2006

(54) ELECTRIC TOY TOP DEVICE WITH FINGER SUPPORTED CHARGING SYSTEM

(76) Inventors: Simeon E. Tiefel, 5852 NE. 197th St., Kenmore, WA (US) 98028; Webb T. Nelson, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 11/040,800

(22) Filed: Jan. 24, 2005

(65) Prior Publication Data

US 2005/0282464 A1 Dec. 22, 2005

Related U.S. Application Data

(63) Continuation-in-part of application No. 10/874,404, filed on Jun. 22, 2004, now Pat. No. 6,913,506.

(51) Int. Cl.
*A63H 1/06* (2006.01)

(52) U.S. Cl. ..... 446/259; 446/233; 2/20

(58) Field of Classification Search ..... 446/256, 446/259, 264, 233; 2/20
See application file for complete search history.

(56) References Cited

U.S. PATENT DOCUMENTS 183,045 A * 10/1876 Dunlop ..... 441/58
690,302 A * 12/1901 Lee ..... 2/20
950,633 A * 3/1910 Eastman ..... 441/58
1,314,053 A * 8/1919 Eissler ..... 2/20
1,962,258 A * 6/1934 Okuda ..... 2/20
3,287,846 A * 11/1966 Frangos ..... 446/235
4,413,443 A * 11/1983 Kulesza et al. ..... 446/26
5,652,955 A * 8/1997 Skewis ..... 2/20
6,586,942 B1 * 7/2003 Lam ..... 324/426
6,685,531 B1 * 2/2004 Tiefel et al. ..... 446/236
6,773,328 B1 * 8/2004 Tiefel et al. ..... 446/459
6,913,506 B1 * 7/2005 Tiefel et al. ..... 446/236

* cited by examiner

*Primary Examiner*—Kien Nguyen
(74) *Attorney, Agent, or Firm*—Lamorte & Associates

(57) ABSTRACT

A system comprising a rotating device, a finger supported charging assembly for powering the rotating device, and a hand pad assembly for holding the rotating device as it spins. The rotating device has a housing with a base upon which the housing spins. An electric motor is contained within the housing that causes the housing to spin when the motor is activated. The finger supported charging assembly includes two contacts that are coupled to opposite terminals of a battery pack. The contacts are worn on opposing fingers and come into contact with the rotating device when the base of the rotation device is supported with the opposing fingers. When contacting the rotating device, the contacts on the opposing fingers provide electricity to the rotating device. The hand pad assembly attaches to a user's hand providing rigid surfaces on the hand that support the rotating device as it spins.

12 Claims, 5 Drawing Sheets

ELECTRIC TOY TOP DEVICE WITH FINGER SUPPORTED CHARGING SYSTEM

RELATED APPLICATIONS

This application is a Continuation-In-Part of patent application Ser. No. 10/874,404 entitled, Electric Toy Top Device With Support And Its Associated Method Of Operation, filed Jun. 22, 2004 now U.S. Pat. No. 6,913,506.

BACKGROUND OF THE INVENTION

1. Field of the Invention

Generally, the present invention relates to toy tops, gyroscopes and other rotating novelty devices. More particularly, the present invention relates to rotating novelty devices that contain internal electric motors that are periodically powered by a separate electric source that is remote to the rotating novelty device.

2. Description of the Prior Art

Tops, gyroscopes and other freely rotating devices share certain common functional features. Tops, gyroscopes and other rotating devices have a central axis around which they spin. The center of gravity associated with the rotating device passes through that central axis and the mass of the rotating device is evenly distributed around the central axis. As the top, gyroscope or similar device is put into motion, the device spins about its central axis. Since the mass of the rotating device is evenly distributed around the central axis, the device spins in a uniform manner, thereby enabling the device to be balanced at a point in line with the central axis. The device will spin in a stable manner until the rotational speed of the device falls below a certain threshold level. As the speed of the device decreases, its angular momentum decreases. Eventually, the presence of angular momentum is insufficient to overcome the forces of gravity and the rotating device tips over.

Tops, gyroscopes and other rotating novelty devices have been in existence for generations. During that period of time, there have been many variations in design of the rotating novelty devices. In their simplest form, rotating novelty devices, such as tops and gyroscopes, are either directly manually spun or manually spun using a pull cord that is wound around the rotating novelty device. Such manual means to provide rotational energy are inexpensive, however the rotational energy provided is relatively small. Consequently, the top or gyroscope would only rotate for a short period of time before they tip over.

The longer a top, gyroscope or other freely rotating device spins, the more play value it generally has. Consequently, in the prior art, attempts have been made to create tops, gyroscopes and other freely rotating devices that spin for extended periods of time. One popular method of creating a device that spins for a prolonged period of time is to place a motor within the structure of the device. The motor spins a weight, thereby producing the angular momentum needed to maintain a spinning motion for as long as the motor is powered.

In the prior art, such devices are typically created by placing an electric motor in the center of the top or other freely rotating device. Batteries are then symmetrically placed around the electric motor so as to be balanced around the center of rotation. The batteries typically serve as the majority of the weight that is spun. As a result, the batteries both provide power to the electric motor and add significantly to the angular momentum of the device. Such prior art devices are exemplified by U.S. Pat. No. 3,628,285, to Murakami, entitled Gyroscopic Top Device.

A problem associated with prior art tops and gyroscopes that contain internal motors and batteries is that great care must be taken in the manufacturing tolerances in order to maintain the proper balance. This raises the cost associated with manufacturing such devices. Furthermore, since the spinning object contains both an electric motor and batteries, the device is rather heavy. Such devices, therefore, have a tendency to become damaged if the commonplace happens and the device falls to the floor after spinning off a table edge or falls out of a child's hand.

A need therefore exists for an improved type of drive system for a spinning top, gyroscope or other freely rotating device that provides rotational energy to the device, yet does not require that batteries be contained within the rotating device. This need is met by the present invention as described and claimed below.

SUMMARY OF THE INVENTION

The present invention is a system comprising a rotating device and a finger supported charging assembly for powering the rotating device. The rotating device has a housing with a base upon which the housing spins. An electric motor is contained within the housing that causes the housing to spin when the motor is activated. The finger supported charging assembly includes two contacts that are coupled to opposite terminals of a battery pack. The contacts are worn on opposing fingers and come into contact with the rotating device when the rotation device is supported with the opposing fingers. When contacting the rotating device, the contacts on the opposing fingers provide electricity to the rotating device that powers the motor within the rotating device. Furthermore, a magnet can be present on one or both of the finger contacts that helps hold the rotating device in place between the finger contacts. The magnets in the finger contacts can also be used to lift the rotating device as it spins.

BRIEF DESCRIPTION OF THE DRAWINGS

For a better understanding of the present invention, reference is made to the following description of an exemplary embodiment thereof, considered in conjunction with the accompanying drawings, in which: restaurant

DETAILED DESCRIPTION OF THE INVENTION

Although the rotating device of the present invention system can be configured in many shapes and styles, such as a gyroscope or freely rotating toy, the rotating device of the present invention system is particularly well suited as a top. Accordingly, the illustrated example of the rotating device of the present invention system will be configured as a top in order to set forth the best mode contemplated for the invention. However, the choice of embodying the rotating device as a top should not be considered a limitation of the possible embodiments of the rotating device.

Figure 1:
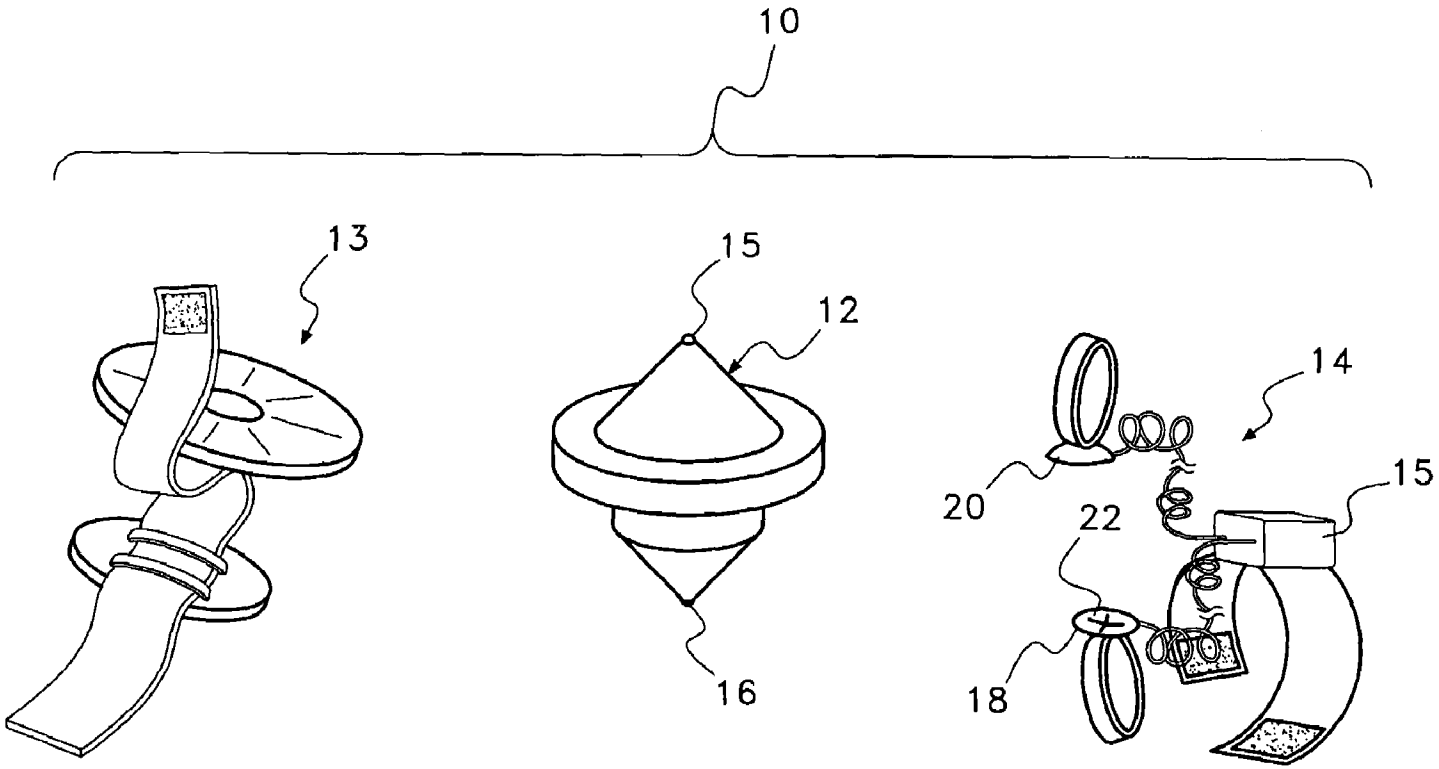
FIG. 1 is a perspective view of an exemplary embodiment of a system in accordance with the present invention.

Referring to FIG. 1, a toy top system 10 is shown. The toy top system 10 is comprised of a top 12, a charging assembly 14 for the top 12, and a hand pad assembly 13 for supporting the top 10 as it spins.

The top 12 has a balance point 16 upon which it balances when it spins. The top 12 also has an apex point 15 at its top that is in the same axis of rotation as the balance point 16. As will later be explained, the top 12 contains an internal motor that causes the top 12 to spin. However, that internal motor must receive electricity from a source external of the top 12.

Figure 2:
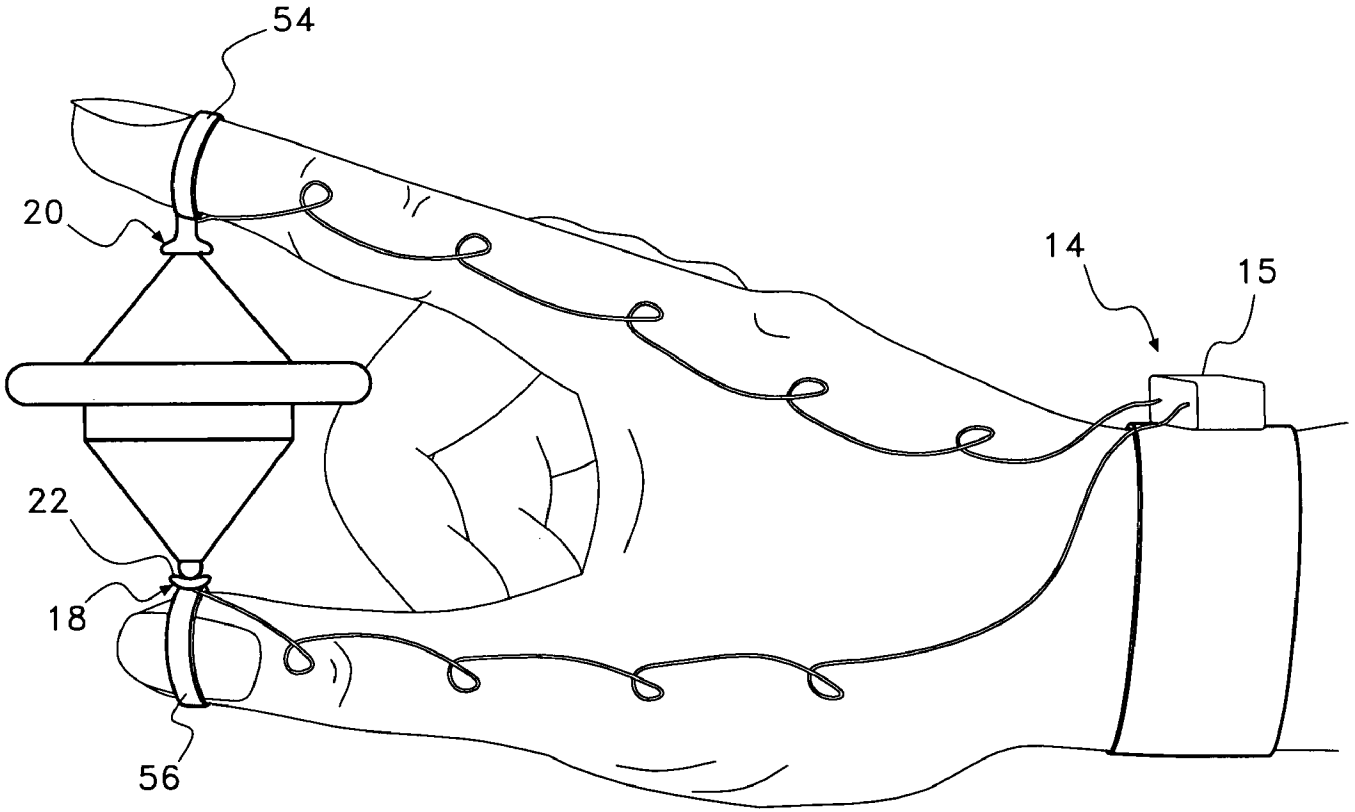
FIG. 2 is a side view of the rotating device being held within the charger assembly in accordance with the present invention.

Referring to FIG. 2 in conjunction with FIG. 1, it will be understood that the charging assembly 14 is worn on the hand. The charging assembly 14 consists of a battery pack 15 and two finger supported charging contacts 18, 20 that are coupled to opposite terminals of the battery pack 15. In the shown embodiment, the two finger supported charging contacts 18, 20 are shown being attached to the thumb and the index finger, respectively. The charging contact 18 worn on the thumb has a contact surface 22 that is either flat or slightly bowl-shaped. The contact surface 22 is sized to receive the balance point 16 of the toy top 12. The opposite charging contact 18 is supported by the index finger. As such, by closing the thumb and index finger together, the apex 15 of the top 12 and the balancing point 16 of the top 12 can be pinched between the charging contact 20 on the index finger and the charging contact 18 on the thumb.

Both the charging contacts 18, 20 are connected to the battery pack 15. The battery pack 15 is worn either on the wrist or on the back of the hand. A flexible wire cable or ribbon cable connects the battery pack 15 to both finger supported charging contacts 18, 20.

The toy top 12 contains an internal electric motor. The internal electric motor causes the top 12 to spin. The internal electric motor is powered only when the apex 15 of the top 12 and the balance point 16 of the top 12 is in contact with the two finger supported charging contacts 18, 20. As a result, when the apex 15 of the top 12 and the balance point 16 of the top 12 touch the finger supported charging contacts 18, 20, the internal electric motor is powered by the battery pack 15 and the rotational velocity of the top 12 increases. Once up to its maximum speed, the top 12 can again be released from the fingers and allowed to spin freely.

The movement of the top 12 is not limited to the confines of the finger supported charging contacts 18, 20. Rather, the top 12 can be flipped out of the support platform 22 onto any smooth surface. As the top 12 eventually slows, the finger supported charging contacts 18, 20 can be used to scoop up the spinning top 12. The top 12 can then be contacted by the thumb charging contact 18, where it will again increase to its maximum rotational speed.

The finger supported charging contacts 18, 20 preferably are magnetic or contain magnets. The magnets create magnetic fields that effect the top 12 as it spins. The magnetic fields cause the top 12 to be slightly biased against the charging contacts 18, as the top 12 spins. This causes the top 12 to create consistent electrical interconnection with the charging contacts 18, 20. The result is that a higher quality electrical connection is made with the top 12 than would occur if the magnet 24 were not present.

The finger supported charging contacts 18, 20 are an assembly of various components. The index finger charging contact 20 contains a ring structure 54 that can be worn around the index finger. The thumb charging contact 18 is connected to a separate ring structure 56. Both finger supported charging contacts are coupled to the opposite terminals of the battery pack 15.

It will therefore be understood, that as the top 12 is held between the finger charging contacts 18, 20, the electric motor 32 is powered and the top 12 will spin under the power of the electric motor 32.

Figure 3:
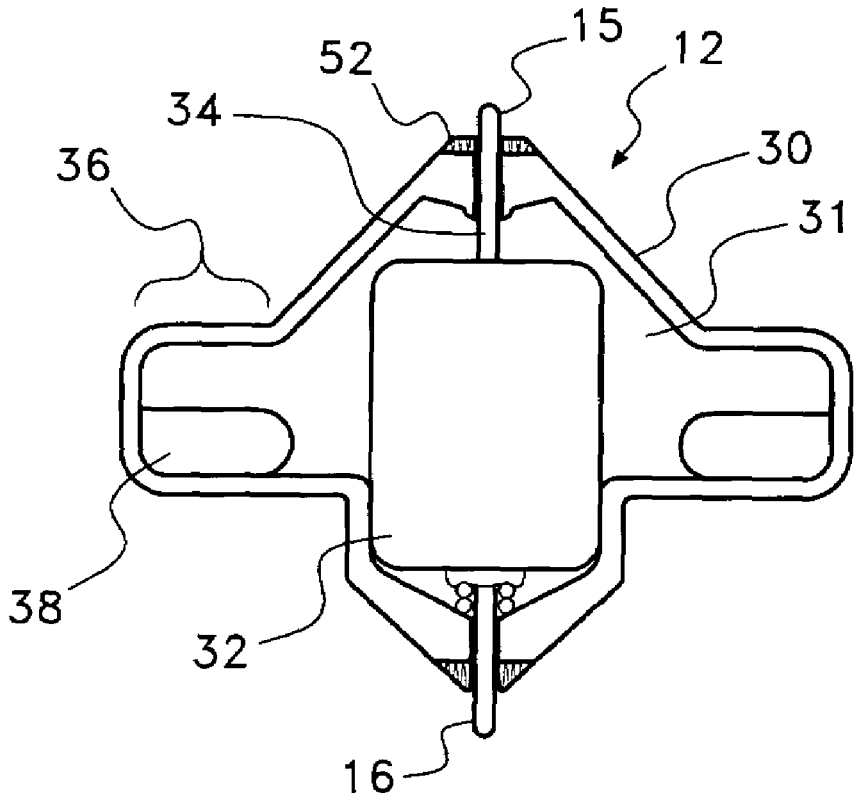
FIG. 3 is a selective cross-sectional view of the toy top.

Referring to FIG. 3, it can be seen that the top 12 is comprised of a housing 30 that defines a central chamber 31. Within the central chamber 31 is a free floating electric motor 32. The output shaft 34 of the electric motor 32 is rigidly connected to the housing 30. Accordingly, the electric motor 32 can remain stationary as its output shaft 34 rotates the top's housing 30 around the motor 32.

The housing 30 has an outer ring section 36. Within the outer ring section 36 is a weighted flywheel 38. The flywheel 38 adds to the mass of the top 12 and provides the angular momentum needed to keep the top 12 stable as the top 12 spins.

The bottom of the top's housing 30 forms the balance point 16 of the top 12. At the tip of the balance point 16 is conductive and leads to the electric motor 32. At the opposite side of the top 12 is the apex 15. The apex 15 is also conductive and leads to the electric motor 32. Thus, the two leads of the electric motor 32 terminate at the top and bottom of the toy top 12.

Near the apex 15 of the top 12 is positioned either a magnet or a mass of ferro-magnetic material 52. Accordingly, the area near the apex 15 of the top's housing 30 will attract to an external magnet.

Figure 4:
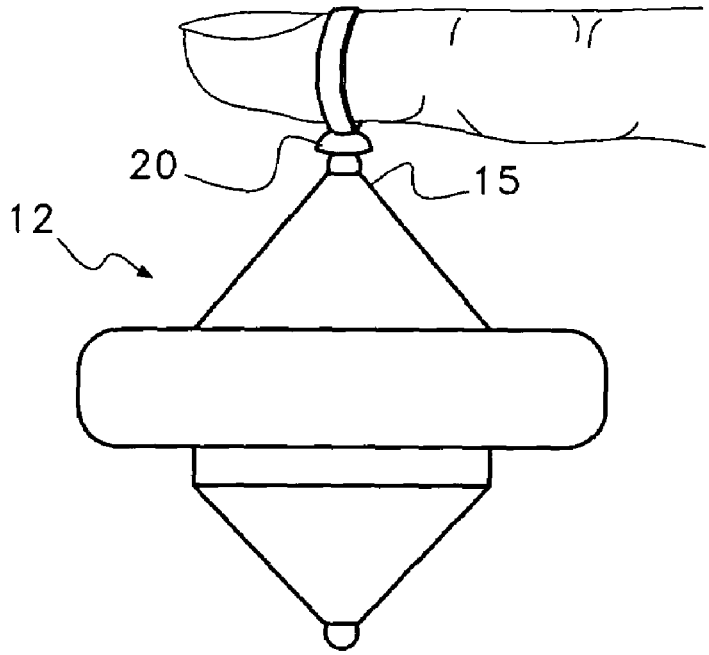
FIG. 4 is a side view of the present invention system where a magnet is being used to lift the rotating device as it spins.

Referring now to FIG. 4, it will be understood, that due to the magnetic attraction embodied by the finger supported charging contacts 18, 20 (FIG. 2), if the apex 15 is touched by either charging contact 18, 20 (FIG. 2), the apex 15 of the toy top 12 will magnetically attach to that charging contact 18, 20. The magnetic attraction between the charging contacts and the apex 15 of the toy top 12 is preferably large enough to support the weight of the toy top 12 as it is spinning. As such, the toy top 12 can be magnetically supported by either its bottom balance point 16 or from its top apex 15 as it spins.

Figure 5:
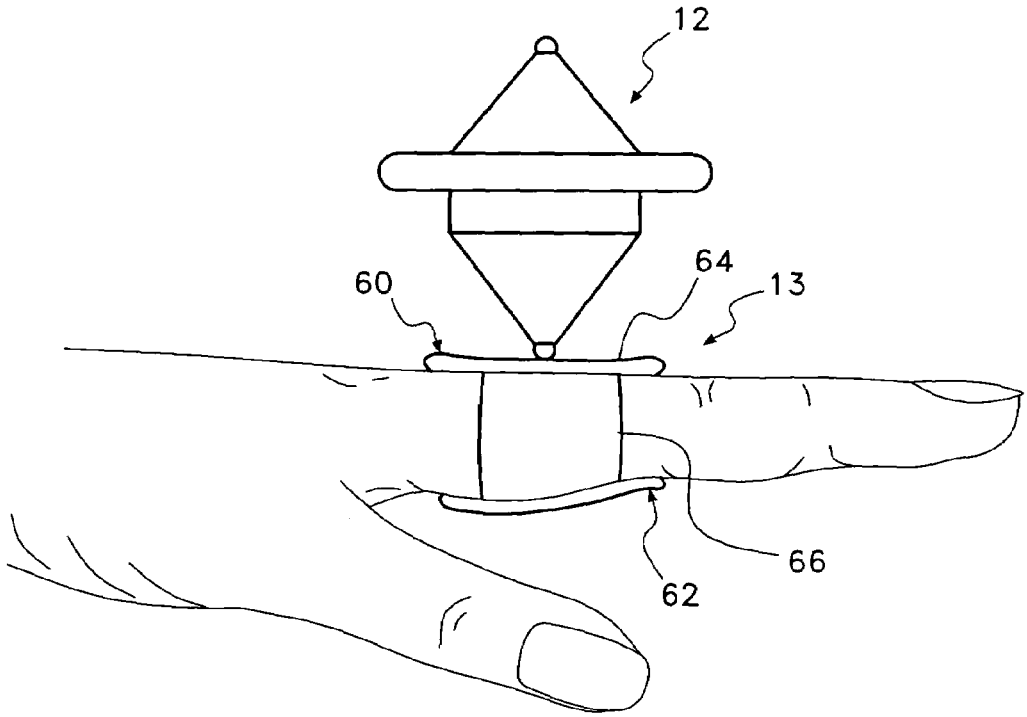
FIG. 5 is a side view of the hand pad assembly component of the present invention system as it supports the rotating assembly.

Referring to FIG. 5, the hand pad assembly 13 that was initially shown in FIG. 1 is more completely described. The hand pad assembly 13 contains two pads 60, 62. Each of the pads 60, 62 has a rigid support surface 64 that is preferably slightly concave. The two pads 60, 62 are interconnected by at least one strap 66. The strap 66 wraps around a person's hand so that one pad 60 is positioned against the palm of the hand and the other pad 62 is positioned against the back of the hand.

The top 12, once made to spin, can be placed onto one of the two pads 60, 62, where it is free to spin. It is preferred that the hand pad assembly 13 be worn on one hand and the charging assembly 14 (FIG. 1) on the opposite hand. In this manner, one hand can be used to charge the top 12 so it spins, while the other hand is used to support the top 12 as it spins.

It will be understood that the embodiment of the present invention system that is described and illustrated herein is merely exemplary and a person skilled in the art can make many variations to the embodiment shown without departing from the scope of the present invention. For instance, the shape of the top is mostly a matter of design choice. Furthermore, the hand pad assembly can be integrally formed as part of the battery pack, wherein a single set of straps hold both the battery pack and the pads onto a person's hands. All such variations, modifications and alternate embodiments are intended to be included within the scope of the present invention, as defined by the appended claims.

What is claimed is:

1. A system, comprising:

a rotating assembly having an apex point and a bottom point disposed upon a common axis of rotation, wherein said rotating assembly rotates upon said bottom point around said axis of rotation;

an electric motor disposed within said assembly, wherein said electric motor rotates said rotating assembly around said axis of rotation when said electric motor is activated; and a charging assembly supported by a user's hand, said charging assembly containing a first contact, a second contact and a battery source coupled to said first contact and said second contact, wherein said battery source powers said electric motor in said rotating assembly when said rotating assembly is held in the user's hand and is brought into contact with said first contact and said second contact.

2. The system according to claim 1, wherein said electric motor has electrical terminals that terminate at said bottom point and said apex point of said rotating assembly.

3. The system according to claim 1, wherein said first contact is coupled to a first ring that enables said first contact to be worn about a first finger.

4. The system according to claim 3, wherein said second contact is coupled to a second ring that enables said second contact to be worn about a second finger.

5. The system according to claim 1, wherein said first contact includes a surface on which said rotating assembly can spin.

6. The system according to claim 5, further including a magnet disposed proximate said first contact.

7. The system according to claim 6, wherein said magnet exerts a magnetic attraction with said rotating assembly sufficient to lift said rotating assembly.

8. The system according to claim 1, further include a hand pad assembly having at least one rigid surface upon which said rotating assembly can spin.

9. The system according to claim 8, wherein said hand pad assembly includes:

a first rigid support surface upon which a top can freely rotate; and at least one strap for selectively attaching said first rigid support surface to the back of a person's hand, therein holding said first rigid support surface flush against the back of the person's hand.

10. The system according to claim 9, wherein said further including a second rigid support surface, wherein said second rigid support surface is coupled to said at least one strap and is held against a palm of the person's hand by said at least one strap.

11. The system according to claim 9, wherein said first rigid support surface is concave.

12. The system according to claim 10, wherein said second rigid support surface is concave.

* * * * *